US006536227B1

(12) United States Patent
Lee

(10) Patent No.: US 6,536,227 B1
(45) Date of Patent: Mar. 25, 2003

(54) DIRECT COOLING TYPE REFRIGERATOR

(75) Inventor: Jung Owan Lee, Seoul (KR)

(73) Assignee: Daewoo Electronics Corporation, Seoul (KR)

( * ) Notice: Subject to any disclaimer, the term of this patent is extended or adjusted under 35 U.S.C. 154(b) by 0 days.

(21) Appl. No.: 10/059,798

(22) Filed: Jan. 29, 2002

(51) Int. Cl.[7] ..... F25B 39/02

(52) U.S. Cl. ..... 62/440; 62/516; 165/171; 29/890.038

(58) Field of Search ..... 62/521, 522, 516, 62/517, 440, 441; 165/171, 168, 169, 156; 29/890.038, 890.043

(56) References Cited

U.S. PATENT DOCUMENTS 2,014,703 A * 9/1935 Smith ..... 62/515
2,625,378 A * 1/1953 Nason ..... 165/136
2,992,545 A * 7/1961 Walker ..... 126/672
3,251,198 A * 5/1966 Cornelius ..... 165/171
3,827,485 A * 8/1974 Hickman et al. ..... 165/171
4,172,444 A * 10/1979 Atkinson ..... 126/660
4,739,634 A * 4/1988 Watanabe ..... 165/169

* cited by examiner

*Primary Examiner*—William E. Tapolcai
(74) *Attorney, Agent, or Firm*—Anderson Kill & Olick, PC

(57) ABSTRACT

A direct cooling type refrigerator includes an outer case, an inner case, a metal plate, an evaporator, an insulator, a first bonding means, and a second bonding means. The inner case is positioned inside the outer case, and the metal plate is positioned on the inner case. The first bonding means is used to attach the metal plate on the inner case. The second bonding means is used to join the evaporator with the metal plate. The insulator is interposed between the cabinet and the inner liner.

17 Claims, 4 Drawing Sheets

DIRECT COOLING TYPE REFRIGERATOR

FIELD OF THE INVENTION

The present invention relates to a refrigerator; and, more particularly, to a direct cooling type refrigerator.

BACKGROUND OF THE INVENTION

Generally, a refrigerator is an apparatus for storing various foodstuffs in either a frozen or a refrigerated condition to extend the freshness of the foodstuffs for a long time. Such a refrigerator essentially includes a compressor, a condenser, and an evaporator. The compressor circulates a refrigerant by compressing the refrigerant. The condenser serves to condense the refrigerant into a liquid phase, and the evaporator serves to generate a chilled air by evaporating the liquid phase refrigerant.

The refrigerator further includes a freezing chamber and/or a refrigerating chamber. The freezing chamber is alternatively referred to as a freezing compartment and serves to store frozen foods such as meats or an ice cream. The refrigerating chamber is alternatively referred to as a refrigerating compartment and serves to store foods at a lower temperature than a room temperature.

There have been developed various types of refrigerators to satisfy various needs, and a direct cooling type refrigerator is one of them. The direct cooling type refrigerator is alternatively referred to as a natural circulation type in which the chilled air naturally circulates in the freezing or the refrigerating chamber because of a temperature difference therebetween. The evaporator of the direct cooling type refrigerator usually directly contacts an inner case forming the freezing chamber and/or the refrigerating chamber.

With reference to FIGS. 1 and 2, a conventional direct cooling type refrigerator 1 and problems thereof will be explained. FIG. 1 shows a top plan view of the conventional direct cooling type refrigerator 1 while FIG. 2 shows a cross-sectional view taken along a line II—II of FIG. 1.

In FIG. 1, the direct cooling type refrigerator 1 includes a cabinet 2, a door 50 assembled with the cabinet 2, an inner liner 4 inside the cabinet 2, and a freezing chamber and/or a refrigerating chamber 60 defined by the inner liner 4. The inner liner 4 is alternatively referred to as an inner case. An evaporator (not shown), a condenser (not shown), and a compressor (not shown) are also contained in the direct cooling type refrigerator 1. The door 50 and the cabinet 2 are assembled usually with, e.g., hinges (not. shown), such that the door 50 can open or close the freezing chamber and/or the refrigerating chamber 60. If both the refrigerating chamber and the freezing chamber 60 are contained in the direct cooling type refrigerator 1, the refrigerating chamber is usually disposed under the freezing chamber 60.

As shown in FIG. 2, the conventional direct cooling type refrigerator 1 further includes a refrigerant pipe 10 and an insulator 20. The refrigerant pipe 10 is disposed on the inner liner 4 and serves as the evaporator. The insulator 20 is interposed between the inner liner 4 and the cabinet 2 to insulate the freezing or the refrigerating chamber 60. The insulator 20 is usually polyurethane, and the inner liner 4 is usually polystyrene. The inner liner 4 conventionally has a multiplicity of recesses 4*a* where the refrigerant pipe 10 is embedded to contact the inner liner 4. The refrigerant pipe 10 is interposed between the inner liner 4 and the insulator 20. The refrigerant is evaporated inside the refrigerant pipe 10, thereby reducing the temperature of the freezing chamber 60.

The conventional direct cooling type refrigerator 1 presents quite a few problems, e.g. a large temperature variation along the inner liner 4. Because the refrigerant pipe 10 directly contacts the inner liner 4 only at the plurality of recesses 4*a* and the inner liner 4 is conventionally made of a heat-resistive material, temperature rapidly differs between a pipe-contacting portion and a non-pipe-contacting portion of the inner liner 4. The above-mentioned temperature variation causes a low cooling efficiency of the conventional direct cooling type refrigerator 1.

Another problem arises in that the inner liner 4 is produced by applying a technology of thermoforming a thermoplastic sheet. Such a technology presents quite a few drawbacks, e.g. difficulties in the dimensional control of the sheets. That is to say, the size, shape, depth, or position of the recesses 4*a* is difficult to be uniform throughout the overall inner liner 4. If portions of the recesses 4*a* are irregularly formed, an assembly of the refrigerant pipe 10 and the inner liner 4 is difficult and therefore a point contact may exist therebetween. The above-mentioned point contact causes an irregular temperature variation along a longitudinal direction of the recesses 4*a*.

Further, when the point contact exists between the refrigerant pipe 10 and inner liner 4, a portion of the insulator 20 may penetrate into gaps formed therebetween because of the point contact. The penetrated portion of the insulator 20 prevents heat transfer between the refrigerant pipe 10 and the inner liner 4, thereby deteriorating the cooling efficiency of the conventional direct cooling type refrigerator 1.

On the other hand, because the refrigerant pipe 10 is very lengthy and the inner liner 4 is heat-resistive, a latent temperature variation exists along the refrigerant pipe 10.

SUMMARY OF THE INVENTION

It is, therefore, an object of the present invention to provide a refrigerator having a relatively lower temperature variation so as to present a high cooling efficiency. According to a preferred embodiment of the present invention, there is provided a direct cooling type refrigerator including: an outer case; an inner case inside the outer case; a metal plate disposed on the inner case; an evaporator disposed on the metal plate; an insulator filling gaps between the inner case and the outer case; a first bonding means for attaching the metal plate on the inner case; and a second bonding means for joining the evaporator with the metal plate.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE PREFERRED EMBODIMENT

Figure 1:
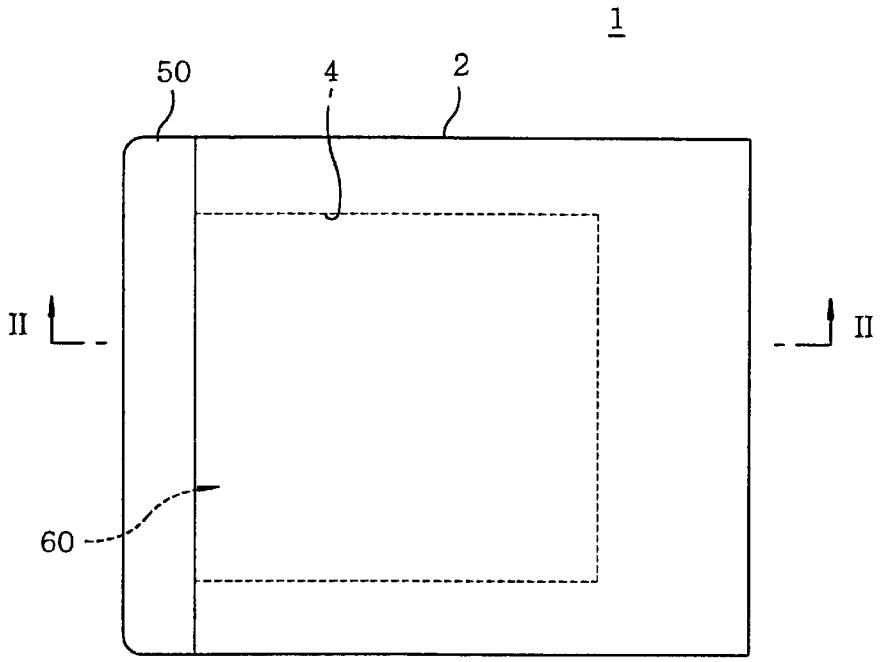
FIG. 1 (PRIOR ART)
FIG. 1 presents a schematic top plan view of a refrigerator according to the prior art.
Figure 2:
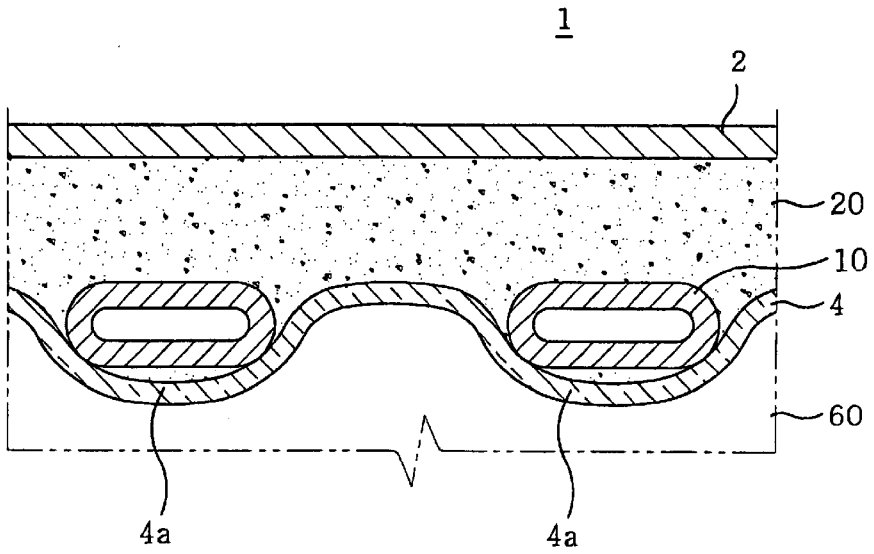
FIG. 2 (PRIOR ART)
FIG. 2 is a partial cross-sectional view taken along a line II—II of FIG. 1.

Referring now to FIGS. 3 to 7, a refrigerator 100 in accordance with a preferred embodiment of the present invention will be described in detail. Like numerals represent like parts in the drawings.

Figure 3:
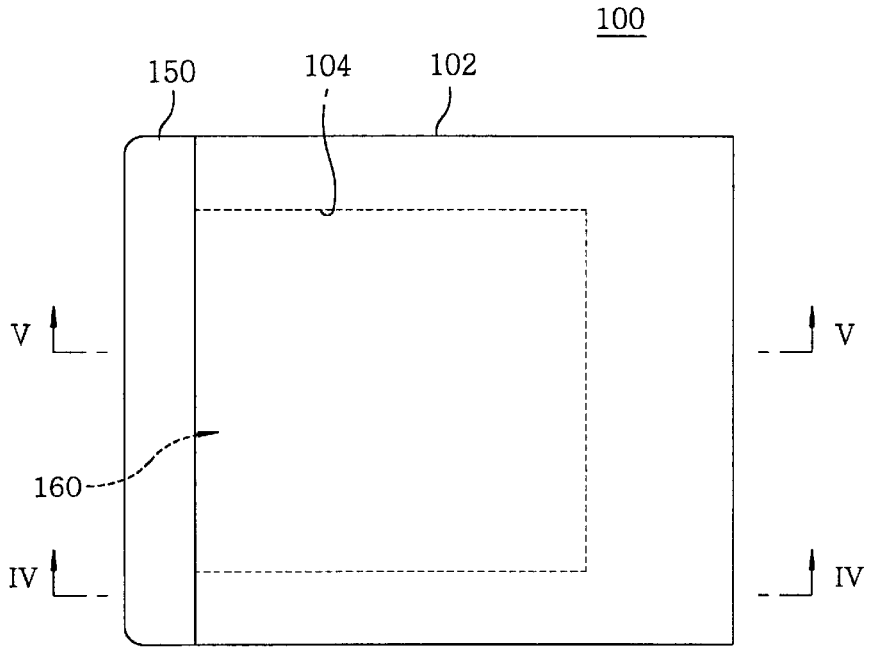
FIG. 3 represents a schematic top plan view of a refrigerator in accordance with a preferred embodiment of the present invention.

In FIG. 3, the refrigerator 100 in accordance with the preferred embodiment of the present invention includes a cabinet 102, a door 150 assembled with the cabinet 102, an inner liner 104 inside the cabinet 102, and a freezing chamber and/or a refrigerating chamber 160 defined by the inner liner 104. The inner liner 104 is alternatively referred to as an inner case, and the freezing and the refrigerating chamber 160 are alternatively referred to as a freezing and a refrigerating compartment, respectively. An evaporator (not shown), a condenser (not shown), and a compressor (not shown) are also contained in the refrigerator 100. The door 150 and the cabinet 102 may be assembled via, e.g., hinges (not shown), such that the door 150 can selectively open and close the freezing and/or the refrigerating chamber 160.

In case that the refrigerator 100 includes both the refrigerating chamber and the freezing chamber 160, the inner liner 104 may take either a single body shape or a dual body shape. In case of adopting the dual body shape, different inner liners may be formed to individually define the refrigerating chamber and the freezing chamber 160. On the contrary, in case of adopting the single body shape, the inner liner 104 may simultaneously define the refrigerating chamber as well as the freezing chamber 160.

Figure 4:
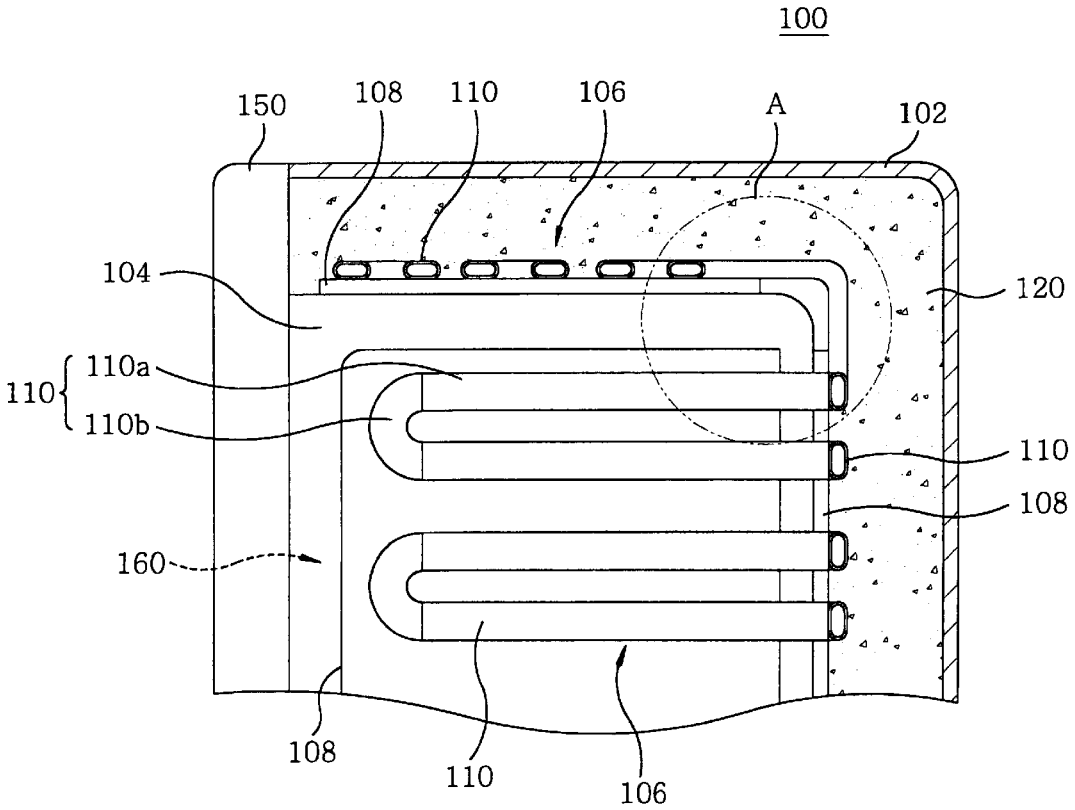
FIG. 4 depicts a partial cross-section taken along a first line IV—IV of FIG. 3.

FIG. 4 shows a partial cross-section taken along a first line IV—IV of FIG. 3. As shown, a pipe on sheet (POS) structure 106 is attached on the inner liner 104 defining the freezing and/or the refrigerating chamber 160. An insulator 120 is interposed between the inner liner 104 and the cabinet 102. The insulator 120 may be polyurethane, and the inner liner 104 may be polystyrene. The POS structure 106 has a metal plate 108 and a refrigerant pipe 110, which serves as a circulating passage of a refrigerant. The refrigerant pipe 110 further serves as an evaporator and has a plurality of parallel portions 110*a* and rounding portions 110*b*. Two adjacent parallel portions 110*a* are connected with each other by one rounding portion 110*b*.

Figure 5:
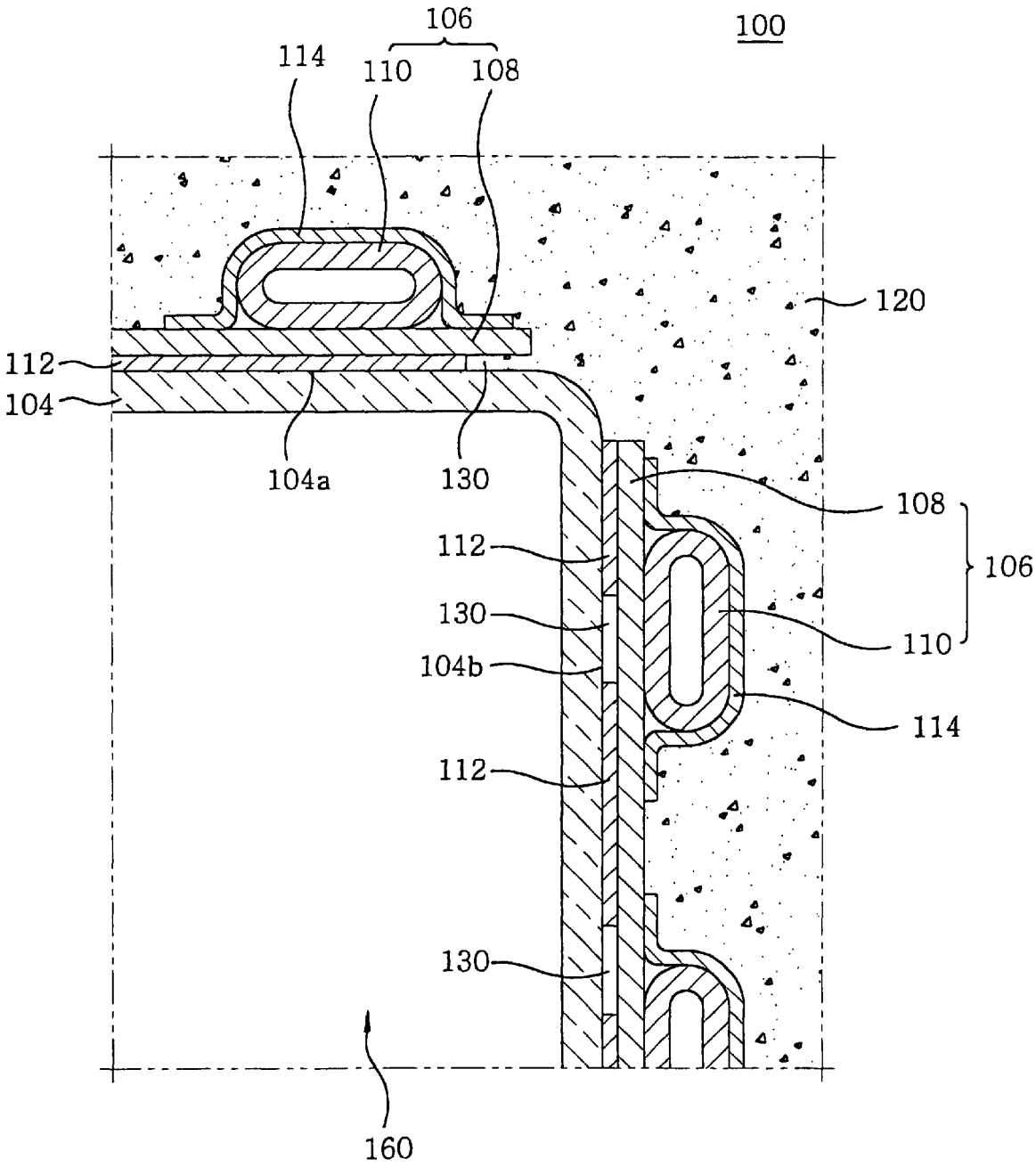
FIG. 5 describes a partial cross-section taken along a second line V—V of FIG. 3.

With reference to FIG. 5, the refrigerator 100 in accordance with the preferred embodiment of the present invention will be described in more detail. FIG. 5 is a partial cross-sectional view taken along a second line V—V of FIG. 3 and corresponds to a portion "A" of FIG. 4.

The POS structure 106 is selectively attached on an outer surface of the inner liner 104, e.g. an upper liner surface 104*a*, a back liner surface 104*b*, or side liner surfaces (not shown) thereof. That is to say, one to four metal plates 108 can be selectively adopted for the POS structure 106. In case of using four metal plates 108, each of the outer surfaces of the inner liner 104, e.g. the upper liner surface 104*a*, the back liner surface 104*b*, and the side liner surfaces, has one metal plate 108 to be attached thereon.

A double tape 112 may be used to bond the inner liner 104 and the POS structure 106. In that case, the double tape 112 is interposed between the inner liner 104 and the metal plate 108 of the POS structure 106. The double tape 112 has two opposite adhesive surfaces, which bond opposing surfaces of the inner liner 104 and the metal plate 108, respectively. The double tape 112 is preferably made of a heat-proof and cold-proof material, such as an acryl-based material.

When the double tape 112 is used for the bonding, a plurality of air gaps 130 may be formed between the opposing surfaces of the inner liner 104 and the metal plate 108. Each air gap 130 serves to prevent a heat transfer between the inner liner 104 and the metal plate 108. From an actual test, it is shown that the air gaps 130 rarely affect the cooling efficiency of the refrigerator 100 if the total area of the air gaps 130 is smaller than about 20% of the area of the bonded metal plate 108. In other words, the total area of the double tape 112 is preferably larger than about 80% of that of the bonded metal plate 108.

In bonding the double tape 112, air is usually sandwiched between the double tape 112 and the inner liner 104 or between the double tape 112 and the metal plate 108, thereby forming an air space therebetween. The air space serves to deteriorate a heat transfer between the inner liner 104 and the POS structure 106. From another actual test, it is shown that if the area of the air space is less than about 10% of the area of the double tape 112, the effect of the air space can be disregarded.

The opposing surfaces of the inner liner 104 and the metal plate 108 may have different flatness. In that case, if the double tape 112 is very thin, portions of the double tape 112 may come off the inner liner 104 or the metal plate 108, such that the bonding strength of the inner liner 104 and the metal plate 108 is deteriorated. Therefore, a thicker double tape 112 is preferred to a thinner one in view of improving the bonding strength. On the contrary, because the thickness of the double tape 112 determines the heat transfer rate between the inner liner 104 and the POS structure 106, the thinner double tape 112 is preferred to the thicker one in view of improving the heat transfer rate. Accordingly, an optimum thickness of the double tape 112 is preferred to a maximum thickness or a minimum thickness.

Still referring to FIG. 5, a protection tape 114 bonds the metal plate 108 to cover the refrigerant pipe 110 of the POS structure 106. The protection tape 114 serves to isolate the refrigerant pipe 110 from the insulator 120, so as to prevent the insulator 120 from penetrating into a possible gap interposed between the refrigerant pipe 110 and the metal plate 108. The protection tape 114 is preferably made of polyethylene.

For forming the insulator 120, an insulating foam is injected into gaps interposed between the inner liner 104 and the cabinet 102 (FIG. 4). Because the protection tapes 114 cover the refrigerant pipe 110, the refrigerant pipe 110 is protected from the insulating foam during the injection of the insulating foam. The insulating foam is subsequently cooled so as to form the insulator 120. The insulator 120 is preferably polyurethane.

Figure 6:
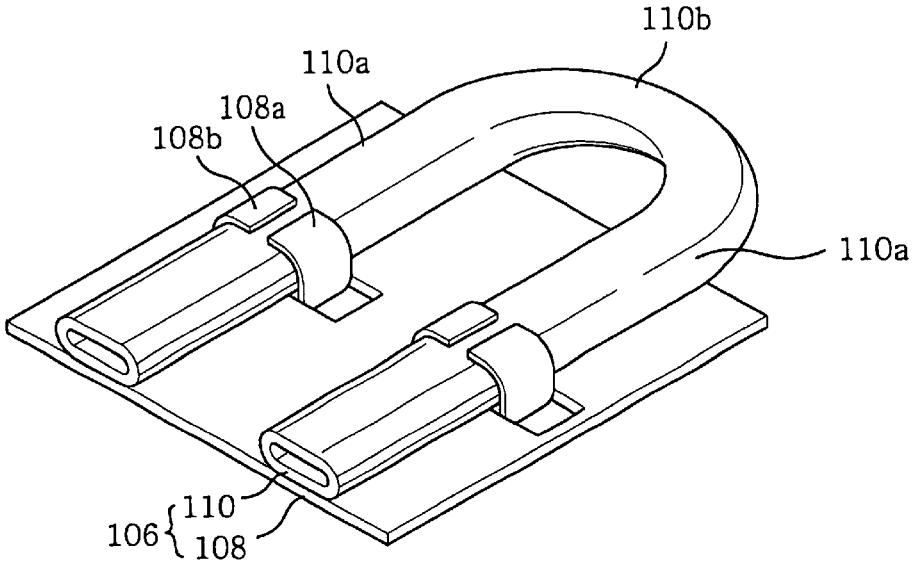
FIGS. 6 and 7 illustrate perspective views of a POS (pipe on sheet) structure of the refrigerator in accordance with the preferred embodiment of the present invention.
Figure 7:
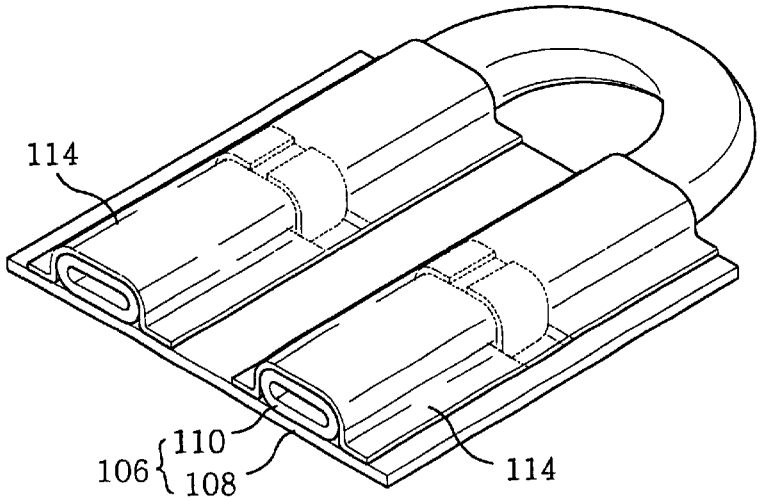

With reference to FIGS. 6 and 7, the POS structure 106 will be described in more detail. FIG. 6 shows a perspective view of the POS structure 106, and FIG. 7 shows the protection tape 114 attached on the POS structure 106 of FIG. 6.

A multiplicity of pairs of a first bending portion 108*a* and a second bending portion 108*b* may be used to join the refrigerant pipe 110 with the metal plate 108. A slitting and a bending process may be applied to the metal plate 108, such that the first and the second bending portion 108*a* and 108*b* are integrally formed with the metal plate 108. The protection tapes 114 bond the metal plate 108 and the refrigerant pipe 110, such that the refrigerant pipe 110 is isolated from an exterior circumstance.

While the invention has been shown and described with respect to the preferred embodiment, it will be understood by those skilled in the art that various changes and modifications may be made without departing from the spirit and scope of the invention as defined in the following claims.

What is claimed is:

1. A direct cooling type refrigerator comprising:

an outer case;

an inner case inside the outer case;

a metal plate disposed on the inner case;

an evaporator disposed on the metal plate;

an insulator filling gaps between the inner case and the outer case;

a first bonding means for attaching the metal plate on the inner case; and a second bonding means for joining the evaporator with the metal plate.

2. The direct cooling type refrigerator of claim 1, wherein the first bonding means is a double tape.

3. The direct cooling type refrigerator of claim 2, wherein the inner case is made of polystyrene.

4. The direct cooling type refrigerator of claim 1, wherein the second bonding means is a pair of bending portions integrally formed with the metal plate.

5. The direct cooling type refrigerator of claim 4, wherein the inner case is made of polystyrene.

6. The direct cooling type refrigerator of claim 1, wherein the inner case is made of polystyrene.

7. The direct cooling type refrigerator of claim 1, further comprising a protection tape covering the evaporator to isolate the evaporator from the insulator.

8. The direct cooling type refrigerator of claim 1, wherein the inner case forms a freezing chamber.

9. The direct cooling type refrigerator of claim 1, wherein the inner case forms a refrigerating chamber.

10. A refrigerator comprising:

a cabinet;

an inner liner inside the cabinet, the inner liner forming a chamber;

at least one metal plate disposed on an outer surface of the inner liner;

a bonding means for bonding the inner liner and the metal plate;

a refrigerant pipe joined on the metal plate; and an insulator interposed between the cabinet and the inner liner.

11. The refrigerator of claim 10, wherein the bonding means is a double tape interposed between the inner liner and the metal plate.

12. The refrigerator of claim 11, wherein the double tape is made of an acryl-based material.

13. The refrigerator of claim 10, further comprising a protection tape covering the refrigerant pipe to isolate the refrigerant pipe from the insulator.

14. The refrigerator of claim 13, wherein the protection tape is made of polyethylene.

15. The refrigerator of claim 10, wherein the inner liner is made of polystyrene.

16. The refrigerator of claim 10, further comprising a door selectively opens and closes the chamber.

17. The refrigerator of claim 10, wherein the refrigerant pipe serves as an evaporator.

* * * * *